US008782828B2

(12) United States Patent
Schulz, Jr. et al.

(10) Patent No.: US 8,782,828 B2
(45) Date of Patent: Jul. 22, 2014

(54) SPRING WIRE SUPPORT FOR FOUNDATIONS AND INNER SPRING MATTRESSES

(71) Applicants: Martin Schulz, Jr., Brenham, TX (US); Martin Schulz, III, Hempstead, TX (US)

(72) Inventors: Martin Schulz, Jr., Brenham, TX (US); Martin Schulz, III, Hempstead, TX (US)

(73) Assignee: Rock Island Industries, Hempstead, TX (US)

( * ) Notice: Subject to any disclaimer, the term of this patent is extended or adjusted under 35 U.S.C. 154(b) by 0 days.

(21) Appl. No.: 13/790,072

(22) Filed: Mar. 8, 2013

(65) Prior Publication Data

US 2013/0239323 A1 Sep. 19, 2013

Related U.S. Application Data

(60) Provisional application No. 61/610,258, filed on Mar. 13, 2012.

(51) Int. Cl.

| | |
|---|---|
| ***A47C 21/00*** | (2006.01) |
| ***A47C 23/043*** | (2006.01) |
| ***A47C 23/02*** | (2006.01) |
| ***A47C 27/045*** | (2006.01) |
| ***A47C 27/07*** | (2006.01) |

(52) U.S. Cl.

CPC ..... *A47C 21/00* (2013.01); *A47C 23/043* (2013.01); *A47C 23/02* (2013.01); *A47C 27/0453* (2013.01); *A47C 27/0456* (2013.01); *A47C 27/07* (2013.01)

USPC ..... 5/267; 5/269; 5/235; 5/260; 5/721; 5/186.1

(58) Field of Classification Search

CPC ..... A47C 27/045; A47C 27/0453; A47C 27/0456; A47C 23/043; A47C 23/0436; A47C 23/05; A47C 23/0507; A47C 23/055

USPC ..... 5/189, 191, 230, 235, 267, 269, 721, 5/186.1, 260, 255, 258, 241, 247; 267/83, 94, 95

See application file for complete search history.

(56) References Cited

U.S. PATENT DOCUMENTS

| | | | | | |
|---|---|---|---|---|---|
| 1,884,270 | A | * | 10/1932 | Rylander | 5/721 |
| 2,133,762 | A | * | 10/1938 | Williams | 112/417 |
| 2,638,606 | A | * | 5/1953 | Austin | 5/239 |
| 2,812,014 | A | * | 11/1957 | Hammond | 267/83 |
| 3,327,332 | A | * | 6/1967 | Richardson et al. | 267/83 |
| 5,878,451 | A | * | 3/1999 | Lumine | 5/191 |
| 6,338,174 | B1 | * | 1/2002 | Stjerna | 5/716 |

* cited by examiner

*Primary Examiner* — Michael Trettel

(74) *Attorney, Agent, or Firm* — Barnes & Thornburg LLP

(57) ABSTRACT

A spring wire support for foundations and innerspring mattresses, and a variable spring surface deck for a foundation and variable spring surface for a mattress. The spring wire support comprises an elongated spring element enveloped in a pliant carrier, with the carrier including an attachment margin. The variable spring surface deck for a foundation comprises a plurality of the spring wire supports secured as desired to an upper surface of a foundation. The variable spring surface for a mattress comprises a plurality of the spring wire supports located between top and adjacent convolutions of rows or columns of springs of the mattress.

16 Claims, 3 Drawing Sheets

FIG. 4
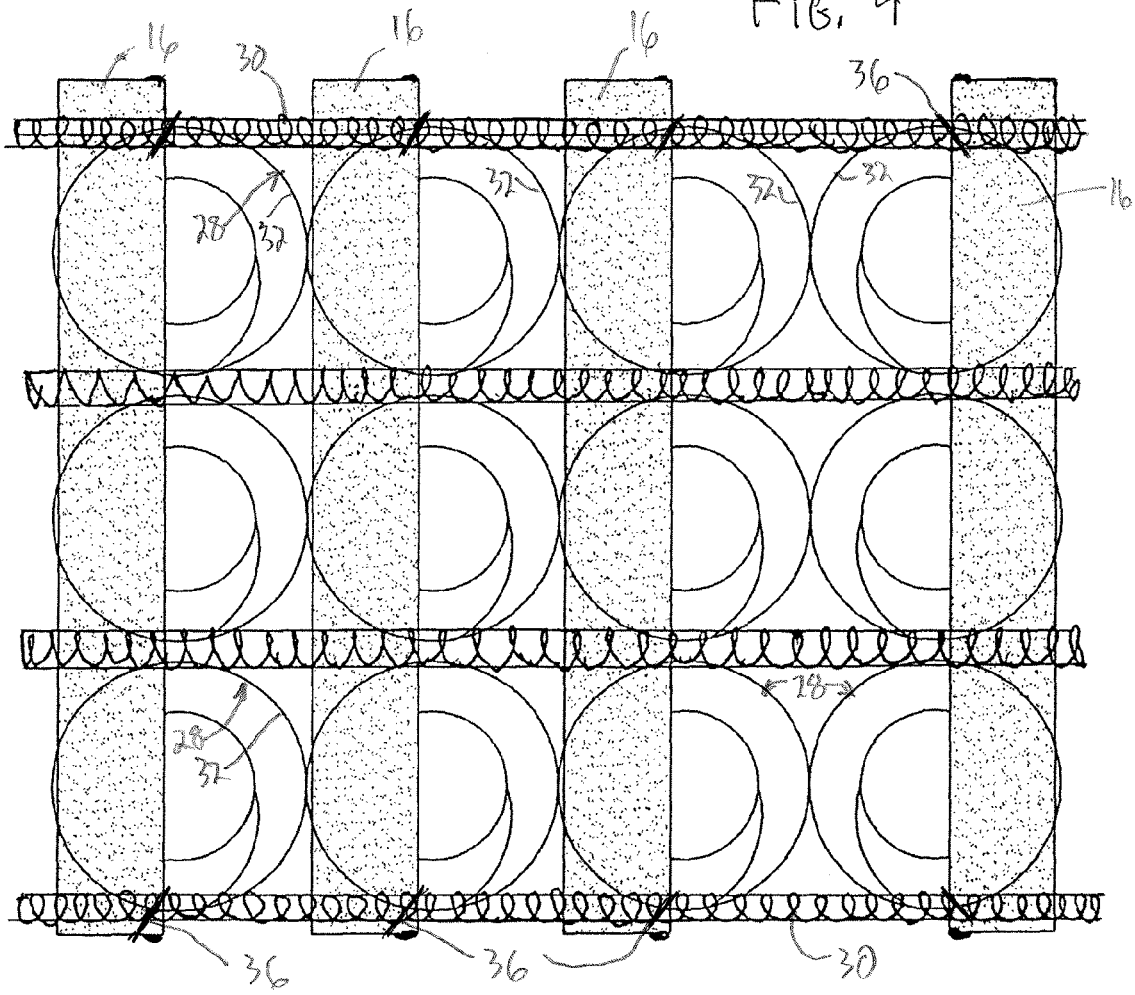
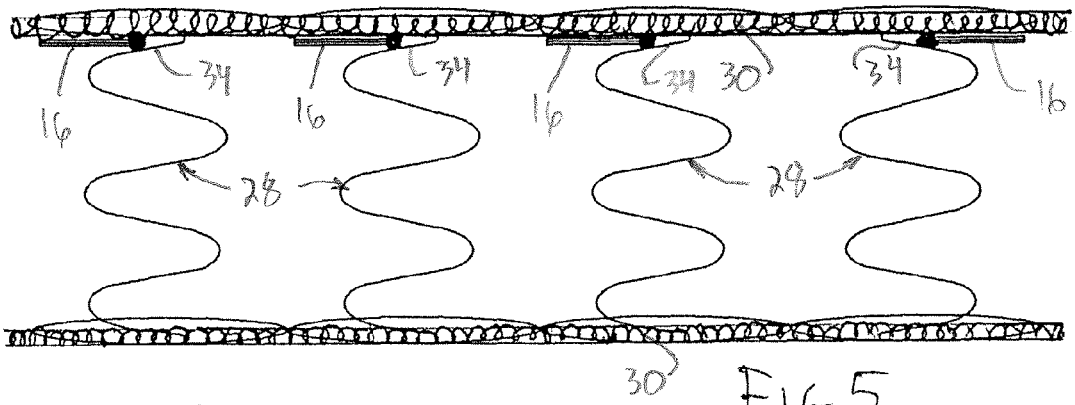
FIG. 5
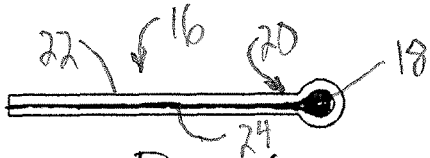
FIG. 6

SPRING WIRE SUPPORT FOR FOUNDATIONS AND INNER SPRING MATTRESSES

RELATED APPLICATION

This application is the Nonprovisional filing of provisional U.S. Patent Application No. 61/610,258.

BACKGROUND OF THE INVENTION

This invention relates to foundation units and innerspring mattresses, and more particularly to a spring wire support for foundations and mattresses, as well as the resulting foundation having a variable spring surface deck and innerspring mattress having a variable spring surface.

Foundation units and innerspring mattresses are found in many forms. Foundation units can be a typical box spring, which is a flat wooden bottom frame, a grid wire top surface, and a series of transverse rows and longitudinal columns of coil springs attached between the grid wire and the wooden frame. Appropriate padding and covering are applied to give the foundation unit a finished look. Alternative foundations can comprise a similar structure but with the wooden frame of a substantially greater depth with commensurately reduced depth coil springs. Other foundations are fabricated using only wooden structure or a rigid wire frame.

Innerspring mattresses may also be found in a myriad of forms. A typical innerspring mattress has top and bottom grid wire surfaces between which transverse rows and longitudinal columns of coil springs extend. Some mattresses are formed so that the top and bottom surface are interchangeable, and others are formed so that only one orientation, with a designated top and bottom, is possible.

Varying the surface support of a foundation unit or innerspring mattress is always a challenge. The invention provides one means of doing so.

SUMMARY OF THE INVENTION

The invention first provides a strengthening device for bedding, comprising an elongated spring element, and a pliant carrier enveloping the spring element. The pliant carrier includes an attachment margin.

Preferably, the elongated spring element comprises a spring metal rod. The pliant carrier is fabric, and in the preferred form of the invention, is felt.

Another form of the invention is a variable spring surface deck for a foundation. The deck comprises a plurality of elongated spring elements, each spring element being enveloped in an individual pliant carrier, with the carrier including an attachment margin, and with the carriers being located on a top surface of the foundation in a spaced orientation. A fastening system utilizes the attachment margin for securing the spring elements to the top surface.

Just as in the first form of the invention, preferably the elongated spring element comprises a spring rod. The pliant carrier is a fabric, and preferably felt. The fastening system preferably comprises a plurality of staples, but could be other fasteners, such as nails, screws or any other means of securing the spring wire elements to the top surface of the foundation.

In the form of the invention providing a variable spring surface for a mattress, the mattress comprises a grid top with parallel rows and longitudinal columns of springs secured to the grid top, with each of the springs comprising helical wire convolutions. The variable spring surface comprises a plurality of elongated spring elements, with each spring element being enveloped in an individual pliant carrier. The spring elements are located between top and adjacent convolutions of each spring of one of a row or column of the springs. Just as in the earlier forms of the invention, the elongated spring element preferably comprises a spring metal rod, and the pliant carrier is a fabric, preferably made of felt.

In this form of the invention, preferably a fastening system is used to secure each spring wire element between the top and adjacent convolutions of the springs. The fastening system may comprise a plurality of spring clamps, with the clamps comprising C-rings secured to the top spring convolutions.

BRIEF DESCRIPTION OF THE DRAWINGS

The invention is described in greater detail in the following description of examples embodying the best mode of the invention, taken in conjunction with the drawing figures, in which:

FIG. 4 is a top plan view of a portion of an innerspring mattress with a variable spring surface, FIG. 5 is a side elevational illustration of the mattress of FIG. 4, and FIG. 6 is an enlarged illustration of the strengthening device for forming the variable spring surface deck of a foundation or variable spring surface of an innerspring mattress.

DESCRIPTION OF EXAMPLES EMBODYING THE BEST MODE OF THE INVENTION

Figure 1:
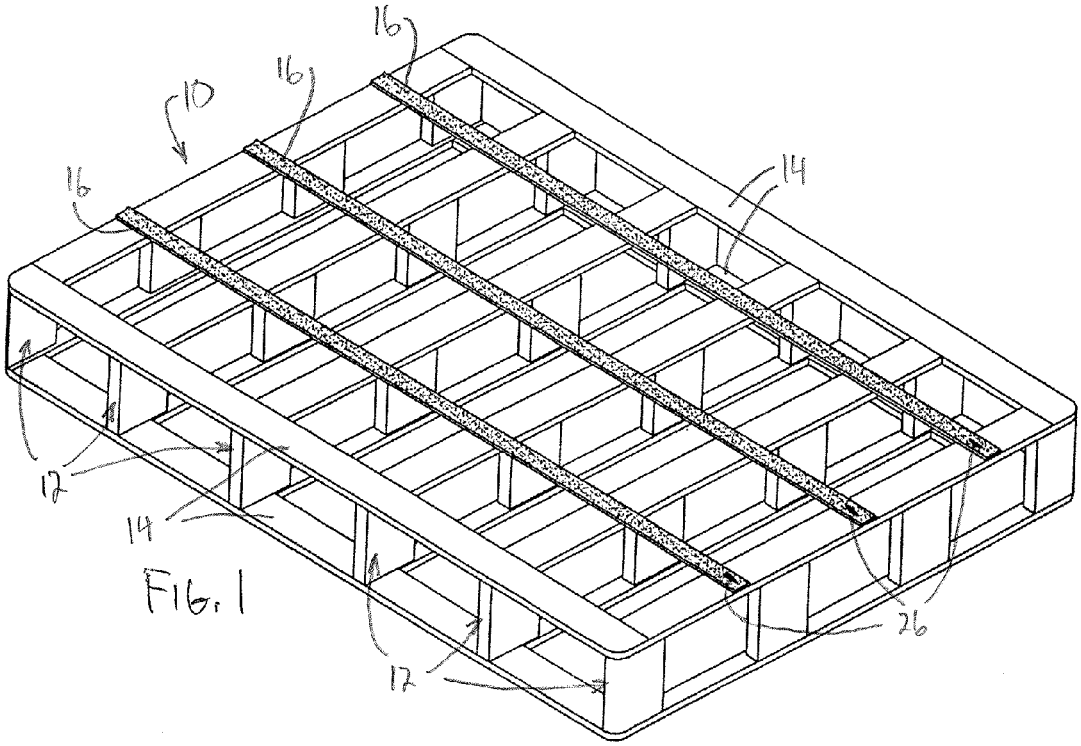
FIG. 1 is an isometric view of one form of a foundation having a variable spring surface deck.
Figure 2:
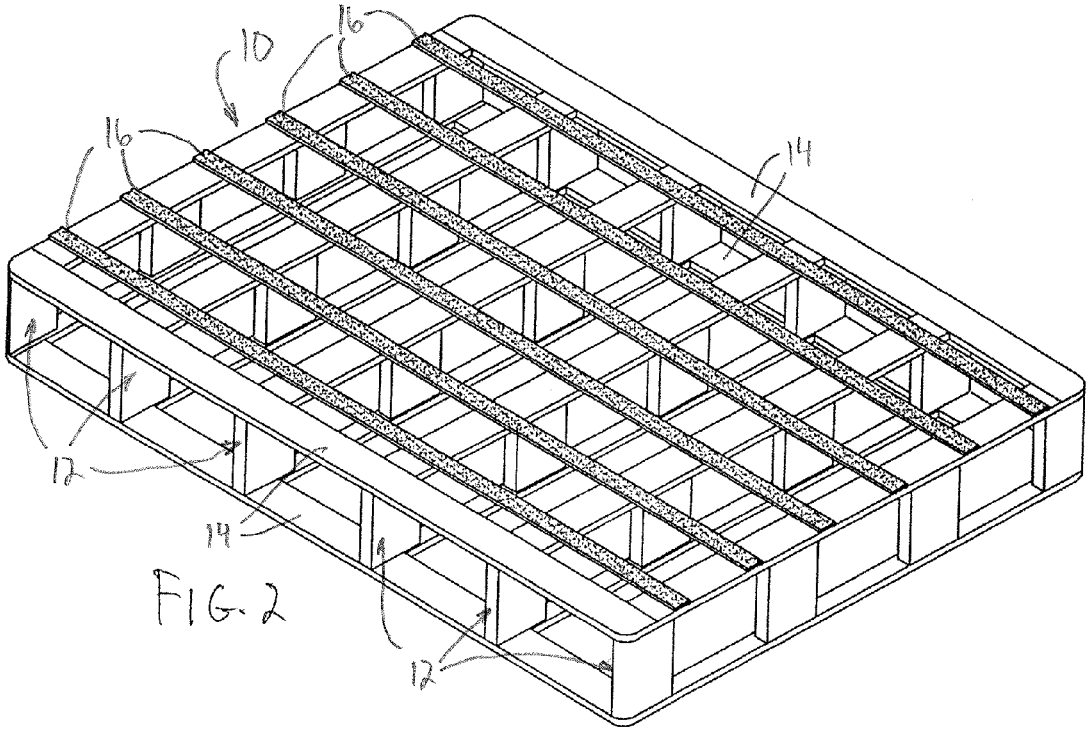
FIG. 2 is an isometric view similar to FIG. 1, but with another form of a variable spring surface deck.
Figure 3:
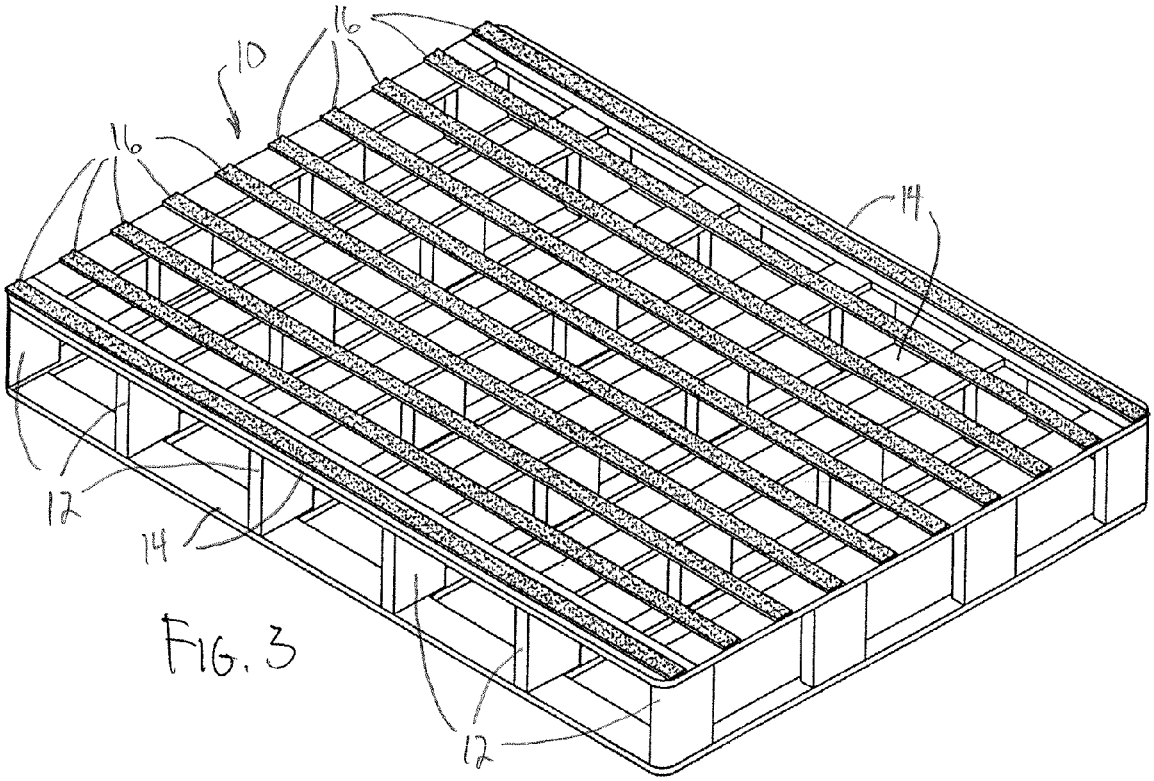
FIG. 3 is an isometric view similar to FIGS. 1 and 2, but with yet a further form of variable spring surface deck.

A variable spring surface deck for a foundation 10 is shown in FIGS. 1-3. While the foundation may be configured in many different ways, the foundation 10 shown in FIGS. 1-3 is of a determined depth and is composed of spaced, parallel rows of trusses 12 interconnected by top and bottom side edges slats 14 on both sides thereof. Alternatively, the foundation 10 can be of other forms, such as the foundations shown in U.S. Pat. Nos. 8,042,205 and 8,091,161, the disclosures of which are incorporated herein by reference.

A variable spring surface deck for each of the foundations of FIGS. 1-3 is composed of a series of spaced spring wire supports 16. The spring wire supports 16 are best shown in FIG. 6, each comprising an elongated spring element 18, preferably in the form of a spring metal rod, with the spring element 18 enveloped in a pliant carrier 20. The pliant carrier 20 includes an attachment margin 22, the attachment margin being that portion of the pliant carrier 20 extending to the left of the spring element 18 shown in FIG. 6. While the spring wire supports 16 are shown extending the length of the foundation 10, it will be evident that the spring wire supports can be oriented cross-wise or any other orientation on the foundation 10, depending on the strength desired. Also, the spring wire supports 16 are preferably longitudinally consistent, that is comprising a single elongated spring element 18 in a single pliant carrier 20, although it will be evident that a spring wire support 16 may be formed in sections.

The pliant carrier 20 is a fabric, preferably felt, although it may be made of other materials. To form the attachment margin, layers of the pliant carrier are joined by an adhesive 24 or any other manner of robustly joining the layers together. Also, while the attachment margin 22 preferably extends the length of each of the spring wire supports 16, it will be evident that the attachment margins can be formed in only the areas where the spring wire supports 16 are secured to the trusses 12 or edge slats 14.

An appropriate fastening system is utilized for attaching the attachment margins 22 to the top surface of the foundations 10. Preferably, the fastening system comprises a plurality of staples 26 appropriately secured through the attachment margins to the trusses 12 and edge slats 16. Simply for the purposes of illustration, staples 26 are shown only in FIG. 1, and only in one of the trusses 12. It is well known to one skilled in the art that as many staples 26 as needed are utilized, typically in each of the trusses 12 over which one of the wire supports 16 passes.

The difference between FIGS. 1, 2 and 3 is in the number of spring wire supports 16 forming the top surface of each of the foundations. Obviously, the greater the number of wire supports, the greater the firmness imparted to the foundation. Also, while the spacings of the spring wire supports 16 in FIGS. 1-3 are shown generally consistently, it will be evident that the spring wire supports 16 can be grouped to provide firmness in desired areas. Thus, the foundations 10 can be formed with greater firmness in the center, or greater firmness toward the sides, or in any combination. The number and location of the spring wire support 16 will dictate the firmness imparted to the foundation 10 and where that may be.

The spring elements 18 must be formed of spring wire, that is, wire that, when displaced, will return to its original orientation. Non-spring wire is unacceptable, since such wire, once displaced, will take on a "set", and will not return. Also, while preferably the spring elements 18 are wire elements, that is, round in cross section, other cross sections of wire elements can be used, so long as they provide the spring support of the invention.

The spring wire supports 16 also are used for forming a variable spring surface for an innerspring mattress, as shown in FIGS. 4 and 5. Any innerspring mattress may be employed, and shown schematically in FIGS. 4 and 5 is simply a series of helical spring coils connected together by top and bottom wire pigtails 30. The particular formation of the innerspring mattress shown in FIGS. 4 and 5 forms no part of the invention, other than the mattress must employ the helical coils 28.

In this form of the invention, stiffening is provided by inserting the spring wire supports 16 between the top and adjacent convolutions of each spring 28 of a row or column of springs 28 in which the spring wire supports 16 are located. Thus, the spring wire supports 16 are located between a top convolution 32 and the adjacent convolution 34.

Typically the spring wire supports 16, when inserted between the top convolution 32 and adjacent convolution 34, will remain in place. However, for added stability, a fastening system can secure the spring wire elements 16 in place. That fastening system comprises a plurality of spaced clamps, preferably C-rings 36. The C-rings bridge the spring wire elements 18 and connect to the top convolutions 32, in a conventional fashion.

Just as in the first form of the invention, the spring supports 16 can be spaced as desired in an innerspring mattress. Thus, not each row or coil of springs 28 need include one of the spring wire supports 16. Firmness can be enhanced depending on where the spring wire supports 16 are located.

The invention, given its versatility, provides almost an infinite variety of ways of providing a variable spring surface to a foundation or innerspring mattress. Various changed can be made to the invention without departing from the spirit thereof or scope of the following claims.

What is claimed is:

1. A strengthening device for bedding, comprising a. an elongated spring element, and b. a one-piece pliant carrier enveloping said spring element, said pliant carrier being wrapped around said spring element and including a first layer overlaying a second layer, the first layer and second layer forming an attachment margin.

2. The strengthening device according to claim 1, in which said elongated spring element comprises a spring metal rod.

3. The strengthening device according to claim 1, in which said pliant carrier is a fabric.

4. The strengthening device according to claim 1, wherein said attachment margin extends outwardly from only one side of said spring element.

5. A variable spring surface deck for a foundation, comprising a. a plurality of elongated spring elements, each spring element enveloped in an individual pliant carrier, each said carrier including an attachment margin, and said carriers being located on a top surface of the foundation in a spaced orientation, and b. a fastening system utilizing said attachment margins and securing said spring elements to said top surface.

6. The variable spring surface deck according to claim 5, in which said elongated spring element comprises a spring metal rod.

7. The variable spring surface deck according to claim 5, in which said pliant carrier is a fabric.

8. The variable spring surface deck according to claim 7, in which said fabric is felt.

9. The variable spring surface deck according to claim 5, in which said fastening system comprises a plurality of staples.

10. A variable spring surface for a mattress, the mattress comprising a grid top and parallel rows and columns of springs secured to the grid top, each spring comprising helical wire convolutions, the variable spring surface comprising a. a plurality of elongated spring elements, each spring element being enveloped in an individual pliant carrier, and b. each spring element being located between top and adjacent convolutions of each spring of one of a row and column of the springs.

11. The variable spring surface according to claim 10, in which said elongated spring element comprises a spring metal rod.

12. The variable spring surface according to claim 10, in which said pliant carrier is a fabric.

13. The variable spring surface according to claim 12, in which said fabric is felt.

14. The variable spring surface according to claim 10, including a fastening system securing each said spring element between said top and adjacent convolutions.

15. The variable spring surface according to claim 14, in which said fastening system comprises a plurality of spaced clamps.

16. The variable spring surface according to claim 15, in which said clamps comprise C-rings each secured to one of said top convolutions.

* * * * *